US009173814B2

(12) United States Patent
Jakobsen et al.

(10) Patent No.: US 9,173,814 B2
(45) Date of Patent: Nov. 3, 2015

(54) LIQUID CONTAINER

(75) Inventors: Jan Børge Jakobsen, Oslo (NO); Peer Børreetzen, Nærsnes (NO); Bjørn Haugseter, Skien (NO)

(73) Assignee: Algeta ASA, Oslo (NO)

( * ) Notice: Subject to any disclaimer, the term of this patent is extended or adjusted under 35 U.S.C. 154(b) by 0 days.

(21) Appl. No.: 14/131,779

(22) PCT Filed: Jul. 12, 2012

(86) PCT No.: PCT/EP2012/063747

§ 371 (c)(1),
(2), (4) Date: Jan. 28, 2014

(87) PCT Pub. No.: WO2013/007806

PCT Pub. Date: Jan. 17, 2013

(65) Prior Publication Data

US 2014/0174978 A1 Jun. 26, 2014

(30) Foreign Application Priority Data

Jul. 12, 2011 (DE) ..... 10 2011 079 031

(51) Int. Cl.

| | |
|---|---|
| ***A61J 1/14*** | (2006.01) |
| ***B65D 23/08*** | (2006.01) |
| ***B65D 25/24*** | (2006.01) |
| ***B65D 51/00*** | (2006.01) |

(Continued)

(52) U.S. Cl.

CPC ..... *A61J 1/1406* (2013.01); *A61J 1/1412* (2013.01); *B65B 3/003* (2013.01); *B65D 23/085* (2013.01); *B65D 25/24* (2013.01); *B65D 51/002* (2013.01); *G21F 5/015* (2013.01); *G21F 5/08* (2013.01); *G21F 5/12* (2013.01); *A61J 1/05* (2013.01)

(58) Field of Classification Search

CPC ..... B65D 65/40; B65D 81/24; B65D 85/70; B65D 85/84; G21F 5/005; G21F 5/002; G21F 5/00; G21F 5/015; G21F 5/018; A61J 1/1406

USPC ..... 206/524.1; 220/23.86, 806, 23.87, 220/23.89, 902; 250/506.1

See application file for complete search history.

(56) References Cited

U.S. PATENT DOCUMENTS 3,707,353 A * 12/1972 Kubiatowics ..... 206/569
3,882,315 A * 5/1975 Soldan ..... 250/506.1

(Continued)

OTHER PUBLICATIONS

International Search Report and Written Opinion for International Patent Application No. PCT/EP2012/063747, dated Dec. 12, 2012 (14 pages).

*Primary Examiner* — Steven A. Reynolds
(74) *Attorney, Agent, or Firm* — Clark & Elbing LLP

(57) ABSTRACT

The present invention relates to a container for liquids, a method of filling it and the use of the container according to the invention for holding and storing radioactive substances. The container for a liquid comprises a cavity for holding the liquid, the cavity being bounded by walls (1) at the sides and at the bottom, an opening for filling the cavity with the liquid, a closure for closing off the cavity, the closure having a piercing region for inserting a cannula into the cavity, a bottom casing (20) which surrounds the walls of the cavity in the standing area, a top casing (10) which surrounds the pierceable closure with the exception of the piercing region, and a film (30) which extends from the top casing to the bottom casing and surrounds those areas of the walls of the cavity which are not already surrounded by the top casing or bottom casing.

13 Claims, 6 Drawing Sheets

(51) Int. Cl.

| | |
|---|---|
| ***G21F 5/015*** | (2006.01) |
| ***G21F 5/08*** | (2006.01) |
| ***G21F 5/12*** | (2006.01) |
| ***B65B 3/00*** | (2006.01) |
| *A61J 1/05* | (2006.01) |

(56) References Cited

U.S. PATENT DOCUMENTS

| | | | | | |
|---|---|---|---|---|---|
| 4,144,461 | A | * | 3/1979 | Glasser et al. | 250/506.1 |
| 4,441,621 | A | * | 4/1984 | Matukura et al. | 215/247 |
| 4,614,515 | A | | 9/1986 | Tripp et al. | |
| 4,703,864 | A | * | 11/1987 | Larkin et al. | 215/256 |
| 4,923,088 | A | * | 5/1990 | Tanaka et al. | 220/23.87 |
| 5,274,239 | A | * | 12/1993 | Lane et al. | 250/370.01 |
| 5,590,782 | A | | 1/1997 | Haber et al. | |
| 7,170,072 | B2 | * | 1/2007 | Schwarz et al. | 250/507.1 |
| 8,003,967 | B2 | * | 8/2011 | Fago et al. | 250/506.1 |
| 8,633,461 | B2 | * | 1/2014 | Fago et al. | 250/506.1 |
| 2006/0076520 | A1 | * | 4/2006 | Drobnik et al. | 250/506.1 |
| 2007/0108205 | A1 | | 5/2007 | Porras | |
| 2008/0197302 | A1 | | 8/2008 | Fago et al. | |
| 2010/0019174 | A1 | * | 1/2010 | Helle et al. | 250/506.1 |
| 2011/0073501 | A1 | * | 3/2011 | Wu | 206/219 |
| 2011/0215264 | A1 | | 9/2011 | Fago et al. | |
| 2011/0215265 | A1 | | 9/2011 | Fago et al. | |
| 2011/0215266 | A1 | | 9/2011 | Fago et al. | |
| 2011/0215267 | A1 | | 9/2011 | Fago et al. | |

* cited by examiner

LIQUID CONTAINER

CROSS-REFERENCE TO RELATED APPLICATIONS

This application is the U.S. National Stage of International Application No. PCT/EP2012/063747, filed Jul. 12, 2012, which claims the benefit of German Patent Application No. 10 2011 079 031.4, filed Jul. 12, 2011.

The present invention relates to a container for liquids, a method of filling it and the use of the container according to the invention for holding and storing materials such as radioactive materials, particularly radioactive material for therapeutic and/or diagnostic purposes.

Containers for holding and storing liquids are everyday objects. In the chemical or medical field, glass bottles that are closed by means of screw caps, crimped closures, stoppers or flanged caps have been successful as storage means for liquids.

Glass bottles have the advantage of being inexpensive, easy to sterilise and inert in the presence of a large number of liquids.

Published German application DE19739139A1 describes by way of example a small volume container made of glass for medical purposes.

Published applications WO1992/00889A1, WO1993/11053A1 and WO1995/04685A1 disclose a container with a combined flanged and snap-on lid closure.

When filling glass bottles with liquids it may happen that drops of the liquid accidentally land on the edge of the bottle or on the outer wall of the bottle. In the case of liquids that constitute a danger to people and/or the environment this is a problem. It is essential to ensure that hazardous substances do not accidentally enter the environment. This applies particularly to radioactive substances.

Radioactive substances are used in medicine for diagnostic and therapeutic purposes. Diagnostic processes in which radioactive compounds are used for example to produce sectional images of living organisms include SPECT (Single Photon Emission Computed Tomography) and PET (Positron Emission Tomography). Substances that emit alpha particles are used for example in treating tumours (radiotherapy).

In the medical field, in particular, contamination of the glass outer wall when filling glass bottles with radioactive substances must be prevented as the glass bottles are handled by hospital staff.

The present invention solves the problem of contamination by providing a new container according to the independent claim 1 and a method of filling the new container according to the invention according to independent claim 12. The invention further relates to the use of the container according to the invention for holding and storing radioactive compounds, particularly radioactive substances for therapeutic and/or diagnostic purposes according to independent claim 10.

Preferred embodiments of the invention can be found in the dependent claims.

Thus in a first aspect the present invention relates to a container for a liquid, containing at least

- a cavity for holding the liquid, the cavity being bounded by walls at the sides and at the bottom,
- an opening for filling the cavity with the liquid,
- a closure for closing off the cavity, the closure having a piercing region for inserting a cannula into the cavity,
- a bottom casing which surrounds the walls of the cavity in the standing area,
- a top casing which surrounds the pierceable closure with the exception of the piercing region, and

- a film which extends from the top casing to the bottom casing and surrounds those areas of the walls of the cavity which are not already surrounded by the top casing or bottom casing.

The container according to the invention has an inner and outer shell. The inner shell surrounds a cavity which serves to hold a liquid. The inner shell thus constitutes a primary vessel into which a liquid can be placed and in which the liquid is stored.

The outer shell surrounds the inner shell. The outer shell is only applied after the cavity has been filled. The outer shell is intended to enclose any residues of liquids that have accidentally reached the outside of the inner shell during filling, so that these residues cannot form a handling or health hazard or enter the environment.

According to the invention the inner shell is formed by walls and a closure. The walls delimit the cavity for holding the liquid at the sides and at the bottom. At the top the cavity is not delimited, i.e. an opening is located here for filling the cavity with a liquid.

Any directional information in the present description relates to the direction of gravity. The term "downwards" means in the direction of gravity. The term "upwards" means in the opposite direction to gravity. Terms such as "lateral" or "to the sides" indicate a direction perpendicular to the direction of gravity.

The walls consist of a material that is impervious to the liquid used and which is not attacked by the liquid used. The man skilled in materials science will be aware of the materials that are suitable for particular liquids.

Preferred materials are glasses or plastics as these are inert to a large number of different liquids, i.e. are not attacked. However it is also possible for the walls to consist of metal, for example. For aqueous solutions, glasses and plastics are particularly suitable, for example polymers such as polyolefins (e.g. polyethylene, polypropylene) or polyesters (e.g. polyethylene terephthalate, polycarbonate). Composite materials are also possible.

In a preferred embodiment a silicate glass is used of the kind conventionally used for storing aqueous chemicals. Such glasses are sold by companies such as Schott AG, for example.

As the container according to the invention is preferably intended to hold single doses of drugs or diagnostic agents, the cavity preferably has a volume of from 1 ml to 200 ml. Particularly preferably, the cavity has a volume of from 2 ml to 100 ml, most preferably from 5 ml to 30 ml.

The walls that bound the cavity for holding a liquid form a primary vessel which may be in the shape of a hollow cylinder in the lower region (particularly externally), according to a preferred embodiment. The hollow cylinder typically tapers upwards, towards the opening, so that the primary vessel may have the shape of a shoulder and/or neck which are typical of many liquid containers. At the end of the neck there is preferably a flange that runs around the opening of the primary vessel and is used for attaching the closure. Other methods of attaching a closure (eg adhesively) may be used equivalently, as will be clear to those of skill in the area. A preferred primary vessel of this kind is shown by way of example in FIG. 1.

After filling, the cavity is closed off. Therefore the container according to the invention has a closure (e.g. shown as 40 and 43 in FIG. 4) which is placed over the fill opening (e.g. 5 in FIG. 1) when the cavity is closed.

The closure and the primary vessel are embodied such that the liquid cannot accidentally escape from the sealed primary vessel. Usually a seal is used such as a sealing ring (O-ring), e.g. made of synthetic rubber. The choice of material for the seal will depend, among other things, on the liquid used and the materials used for the primary vessel and closure. The man skilled in materials science will know which materials are suitable and many options are readily available to the skilled worker.

In a preferred embodiment the closure has an apron with which the closure can be secured on the flange of the primary vessel in the manner of a snap-on lid closure or a flanged closure.

The closure is preferably configured to be pierceable. This means that a cannula can be pushed through the closure to insert it into the cavity and remove liquid. For this purpose the closure has at least one region through which a cannula can be pushed. This region is referred to here as the piercing region. The term "cannula" is used herein to indicate any hollow piercing element suitable for the withdrawal or transfer of liquids. This will include any hollow needle, cannula, tube or similar device formed of metal, plastic or any suitably rigid material.

For example, the closure used may be a flanged aluminium cap with a silicon/PTFE septum or a septum made of synthetic rubber, as is generally conventional in injection ampoules in the medical field (PTFE=polytetrafluorethylene, the PTFE layer is on the side facing the liquid).

The container according to the invention further comprises a bottom casing. The bottom casing surrounds the walls of the cavity at its base. In other words: the primary vessel sits into the bottom casing. The bottom casing forms a kind of shoe for the primary vessel. It protects the primary vessel at its base and also ensures its stability.

The joint between the primary vessel and the bottom casing may be formed in various ways. For example, it is possible for the bottom casing to be frictionally or interlockingly connected to the primary vessel and/or joined with a suitable adhesive. It is possible for the bottom casing and the primary vessel each to have a thread which allows the primary vessel and bottom casings to be screwed together. Preferably the bottom casing is frictionally connected to the primary vessel.

In addition to the bottom casing the container according to the invention has a top casing. The top casing surrounds the pierceable closure, the piercing region being excluded from the covering such as by means of an opening in the top casing. In a preferred embodiment the top casing has an opening of the same (or substantially the same) size as the piercing region, positioned so as to be aligned with the piercing region after the top casing and closure have been joined together. The top casing may also surround upper parts of the primary vessel.

The connection between the closure and top casing may take various forms. For example, it is possible for the top casing to be frictionally or interlockingly connected to the closure (and optionally to the primary vessel) and/or connected by means of an adhesive. It is possible for the top casing and the closure to have threads which allow the components to be screwed together. Preferably, the top casing is frictionally connected to the closure.

The bottom and top casing preferably consist of an elastic material capable of cushioning impact. If the vessel is made of glass, for example, which is known to be brittle and hence comparatively easy to break, the bottom and top casing preferably provide impact protection in the bottom and top regions of the vessel.

Preferably the bottom and top casing consist of a plastic such as for example a synthetic rubber or a thermoplastic. Composite materials may also be used. The bottom and top casing may be made of the same or different materials. Preferably, they are made of the same materials. Examples of preferred materials include polymers such as polyolefins (e.g.; polyethylenes, polypropylenes) or polycarbonate.

In a particularly preferred embodiment the primary vessel has the external shape of a hollow cylinder in its lower region. The bottom casing consists of an elastic material and is adapted to the shape of the primary vessel. In a preferred embodiment, the internal diameter of the bottom casing being somewhat smaller than the external diameter of the primary vessel in the lower region (e.g. having an internal diameter 0.5% to 10% smaller than the external diameter of the primary vessel in the lower region). The bottom casing is pushed over the lower part of the primary vessel in order to attach it; the elastic material expands and provides a frictional connection between the bottom casing and primary vessel.

The internal shape of the primary vessel may, in an optional embodiment, differ from the external shape of the primary vessel, especially in the lower region. In particular, the primary vessel may taper internally to aid the removal of small volumes of liquid from the container (e.g. at the end of fluid withdrawal). This can be achieved by varying the thickness of the walls at the sides and bottom (e.g. parts 3 and 2 respectively in FIG. 1) so as to achieve an internal taper while maintaining a substantially cylindrical external shape in the lower region.

Analogously, a preferred connection is made between the top casing and the closure: the closure is of cylindrical configuration; the top casing consists of an elastic material and is adapted to the shape of the closure. In a preferred embodiment, the internal diameter of the top casing being somewhat smaller than the external diameter of the closure (e.g. having an internal diameter 0.5% to 10% smaller than the external diameter of the closure). The top casing is pushed over the closure to secure it; the elastic material thus expands and provides a frictional connection between the top casing and the closure. For the man skilled in materials and connection technology it is obvious how the bottom casing, top casing, primary vessel and closure have to be configured to enable the primary vessel to be pushed into the bottom casing and the top casing to be pushed onto the closure without the bottom and top casing slipping off again.

The connection of the bottom and top casing to the primary vessel and closure do not have to be particularly solid as the components are also fixed by means of a film (see below). The connection should moreover be at least precisely strong enough to prevent the bottom and top casing from slipping off. It is important that the components should be capable of being joined together easily. The filling process should in principle be capable of automation. For rapid and frictionless operation it is important that the primary vessel should be fitted easily into the bottom casing and that the top casing should be fitted easily onto the closure.

The bottom casing and top casing also provide areas for connection by means of a film.

In a preferred embodiment the top casing is in the form of a telescopic cylinder with an upper, tapering portion and a lower, widened portion. A top casing of this type is shown by way of example in FIG. 5. The tapered portion is fitted over the closure and provides a frictional connection. The widened portion surrounds the neck and shoulder of the primary vessel and fits flush against the cylindrical belly region of the primary vessel. This preferred embodiment produces a bottle which is very suitable for attachment with the film or foil.

The film of the container according to the invention extends between the bottom casing and the top casing and joins them together. The film surrounds the areas of the primary vessel that are not already surrounded by the bottom or top casing (save that it does not typically cover and opening in the top casing that aligns with the piercing region of the closure). The connection of the film to the bottom casing, top casing and primary vessel is preferably carried out by means of a layer of adhesive. However, it is also possible to shrink-fit the film onto the bottom casing, top casing and primary vessel. The film provides mechanical stabilisation of the assembly of primary vessel, closure, bottom casing and top casing. The film safely encloses any contaminants that have got onto the outer wall of the primary vessel during the filling of this vessel. The assembly of bottom casing, top casing and film constitutes a second skin for the primary vessel and thereby on the one hand protects the primary vessel and its contents from external influences but also provides protection for the environment in case the primary vessel breaks and the liquid threatens to escape from the primary vessel. This is in addition to enclosing any surface contamination and thus reducing the risk posed thereby.

Therefore, the film preferably consists of a material which, like the primary vessel, is not attacked by the liquid. Examples of preferred materials are polymers such as polyolefins (e.g. polyethylene, polypropylene) or polyesters. Composite materials are also possible.

In one embodiment, the film is of sufficient size to wrap completely around the eternal circumference of the primary vessel (and preferably also of the top and bottom castings). Thus, the film may additionally be sized to be longer than the external circumference of the primary vessel such that an overlap exists whereby the film laps over itself. In this embodiment the film may secure at least partially to itself, for example by means of an adhesive. By providing a film of at least the size of the circumference of the primary vessel, the external side walls of the vessel may be completely encapsulated with corresponding encapsulation of any surface contamination. Any overlap may be, for example, 1% to 50% of the circumference of the primary vessel.

In a preferred embodiment the container according to the invention additionally has a sealing film. This seals the opening of the top casing over the piercing region. The sealing film is preferably adhesively bonded to the top casing. The sealing film may be designed so that it can be completely or at least partially removed again to provide access to the piercing region. Alternatively the sealing film may also be pierced by the cannula.

The container according to the invention is suitable for the storage and transporting of different liquids. Preferably, it is used for liquids which represent a danger to people or the environment.

The present invention further relates to the use of the container according to the invention for storing radioactive substances, particularly radiotherapeutic and/or diagnostic agents, most preferably substances that emit alpha particles. Preferably the container according to the invention holds a single dose for the treatment of a human being or animal or for diagnostic use in a human or animal.

The container of the invention (and all other aspects) is particularly suited to use with liquids containing alpha-emitting radionuclides. This is because such alpha-emitting radionuclides are hazardous and/or toxic and subject to strict controls but alpha radiation is readily stopped by materials such as plastics which are suitable for the formation of the top and bottom casings and films referred to herein. Thus hazards for alpha-emitting radionuclides are effectively avoided or limited by encapsulation of any surface contamination by the methods described herein.

The preferred embodiments mentioned above for the containers according to the invention also apply analogously to the use according to the invention.

Before the use of the novel container a liquid is first placed in the primary vessel. It is possible for the primary vessel to be sterilised before being filled. The skilled man in the field of medicine and sterilisation technology will be familiar with suitable methods, of which so-called autoclaving is mentioned here by way of example. After filling, which is preferably carried out automatically using corresponding pipetting robots, the primary vessel is sealed in fluidtight manner—again preferably automatically—with a pierceable closure.

It is possible to carry out sterilisation, e.g. by autoclaving, after the sealing process.

It is conceivable that during the filling or sealing of the primary vessel or during any sterilisation process contamination may occur to the outer wall of the primary vessel. It is possible, for example, that a drop of the liquid will land on the edge of the primary vessel opening during filling and tiny amounts of the liquid will not be sealed in the primary vessel during sealing but will remain between the primary vessel and the closure, so that there is a risk of these amounts entering the environment. In the case of radioactive substances (such as alpha-emitting radionuclides), in particular, it is absolutely essential to prevent contamination of the environment.

Therefore after filling and sealing and sterilisation, if applicable, the container according to the invention is enveloped: the primary vessel is provided with a bottom casing, the closure is provided with a top casing, the remainder of the primary vessel is provided with a film which is also covered by parts of the top and bottom casings and optionally a sealing film is placed over the piercing region.

The present invention thus also includes a method of filling the container with a liquid. The method according to the invention comprises at least the following steps:

- filling a primary vessel with a liquid (e.g. a liquid containing at least one toxic and/or hazardous substance such as an a radionuclide),
- closing the filled primary vessel,
- providing the primary vessel with a bottom casing at the base,
- providing the closure with a top casing,
- enveloping those parts of the primary vessel that are not already enclosed by the bottom casing or top casing with a film, the film extending from the bottom casing to the top casing and joining these together (save that any opening in the top casing may be left un-encapsulated or may be encapsulated by a further sealing film).

The preferred embodiments mentioned above for the container according to the invention also apply analogously to the method according to the invention.

In a preferred embodiment of the method according to the invention the film that has an adhesive layer on one side is wrapped around the primary vessel to attach it to the primary vessel. The process is preferably automated. The film is preferably a transparent or substantially transparent film. This allows that the contents of the container may remain visible.

In a further embodiment, the invention provides for a method for reducing a hazard from radiation emanating from surface contamination of a primary vessel containing at least one radioisotope comprising:

- closing the filled primary vessel,
- providing the primary vessel with a bottom casing in the standing area,
- providing the closure with a top casing,
- enveloping those parts of the primary vessel that are not already surrounded by the bottom casing or top casing with a film, the film extending from the bottom casing to the top casing and connecting them to each other.

Such a hazard may be any hazard associated with radionuclides and particularly alpha-radionuclides, such as a handling hazard, a contamination hazard, and/or and environmental hazard. All embodiments and definitions described herein may be applied to this aspect of the invention, where context permits, especially those described herein as preferred.

The invention, in a further aspect provides for the use of a top casing, a bottom casing and a film extending from the bottom casing to the top casing to reducing a hazard from radiation emanating from surface contamination of a filled primary vessel containing at least one radioisotope.

Such a hazard may be any hazard associated with radionuclides and particularly alpha-radionuclides, such as a handling hazard, a contamination hazard, and/or and environmental hazard. All embodiments and definitions described herein may be applied to this aspect of the invention, where context permits, especially those described herein as preferred.

A preferred embodiment will now be described in more detail, for further explanation of the invention, but without restricting the invention to this embodiment.

EXAMPLE

A container was produced from the following components:

Primary vessel: 10 ml clear glass specimen vessel (e.g. vial) or a 10 ml injection ampoule made of clear glass, glass type I (ISO 719 or ISO 720), manufactured according to the European Pharmacopoeia.

Closure: Flanged aluminium cap with rubber stopper.

Top cap: Injection moulded part made of polypropylene (Bormed™HF840MO made by Borealis AG).

Bottom cap: Injection moulded part made of polypropylene (Bormed™HF840MO made by Borealis AG).

Film: Stralfors Label Material LR2240 (Stralfors AG), self-adhesive composite material consisting of a transparent polyolefin film and an acrylic adhesive.

FIGS. 1-5 show the container produced and its components.

Figure 1:
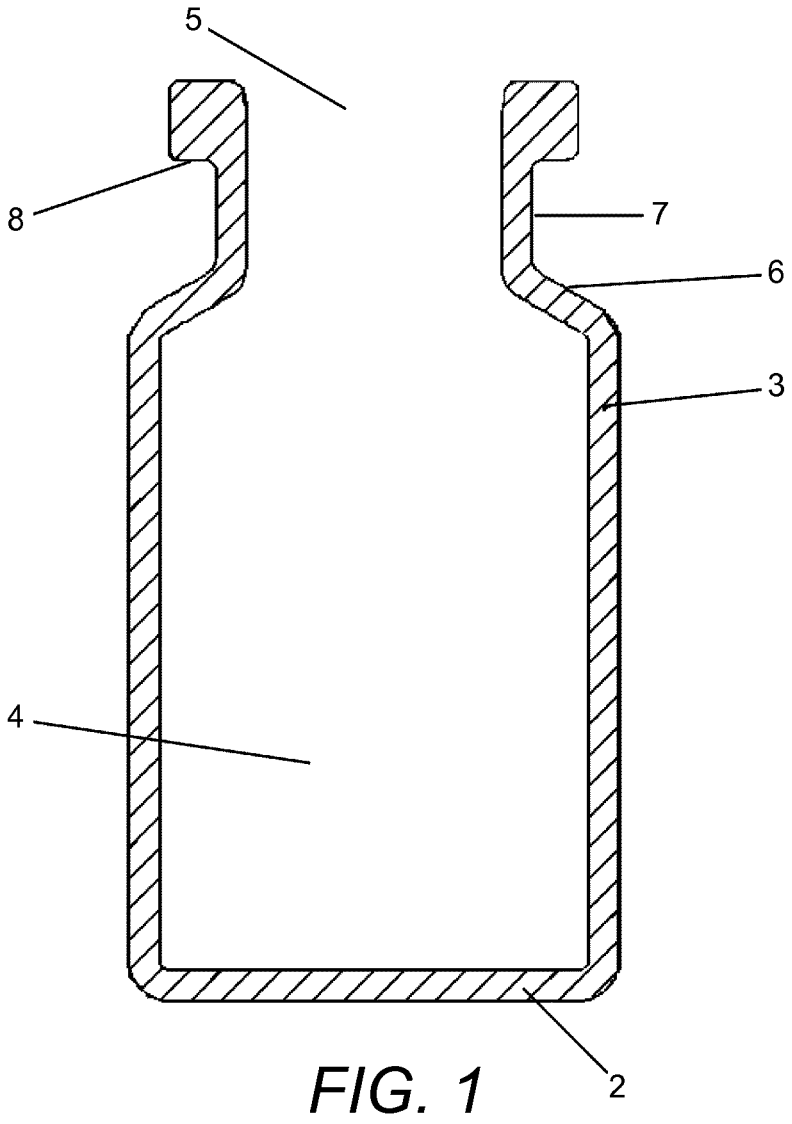
FIG. 1 shows the primary vessel in cross-section from the side
Figure 4:
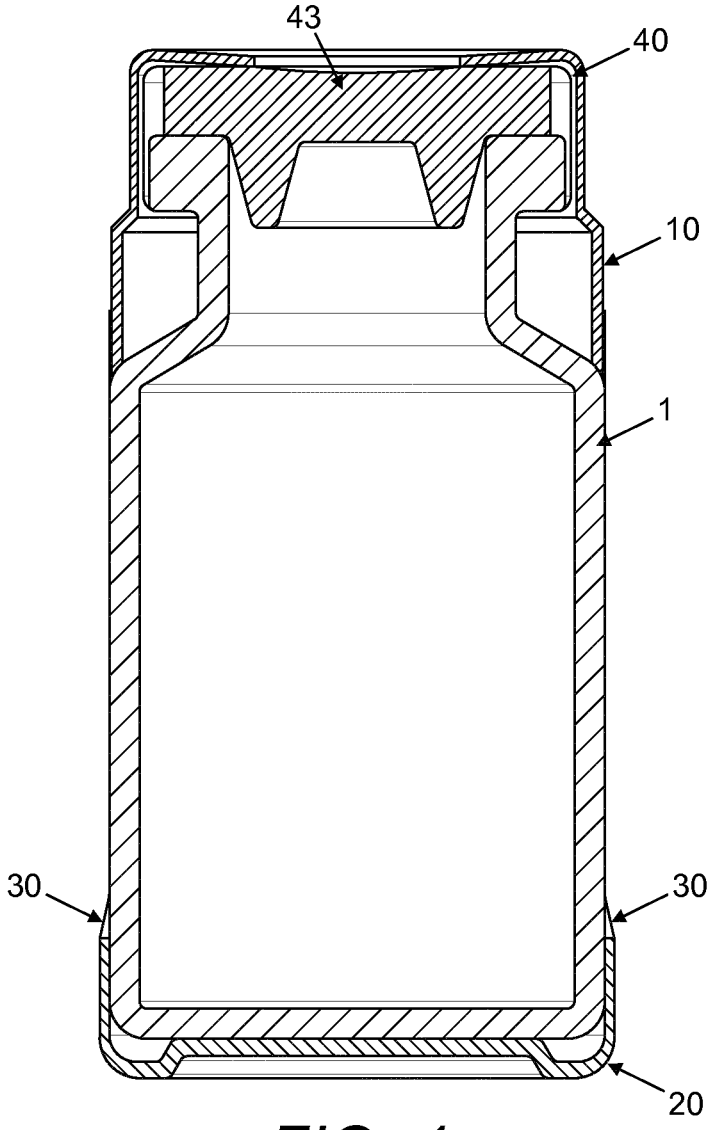
Figure 5:
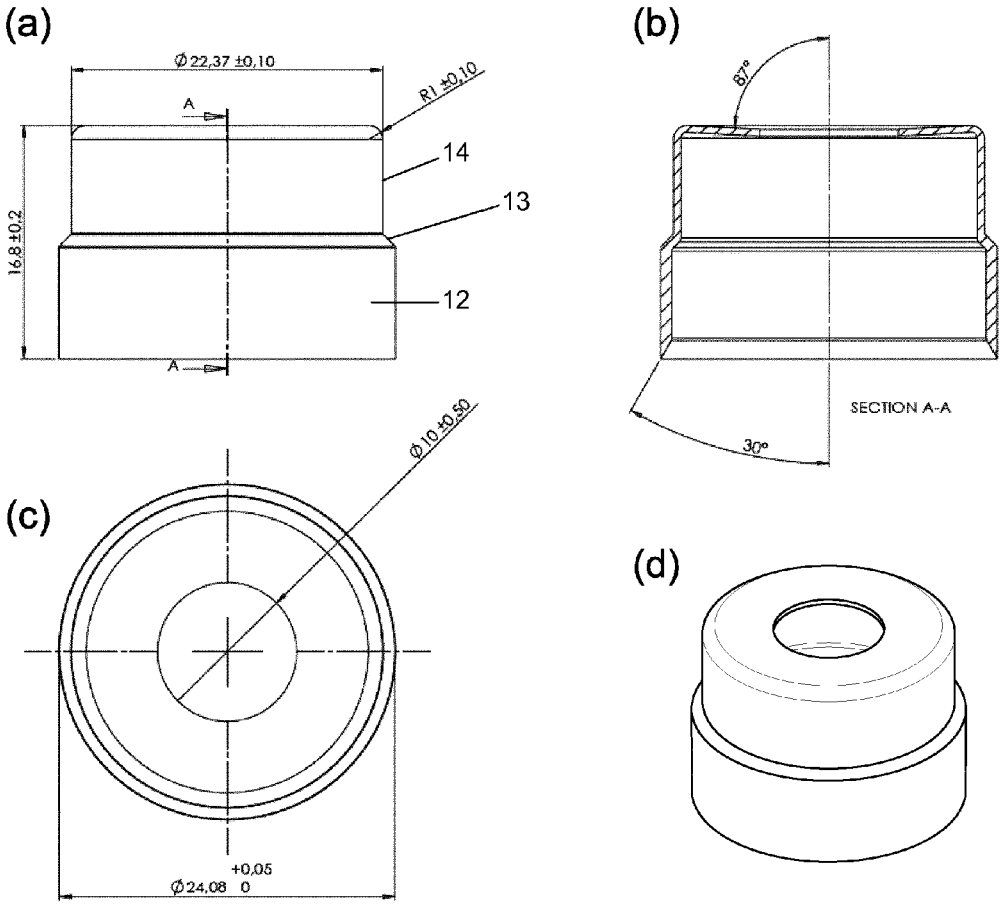
Figure 6:
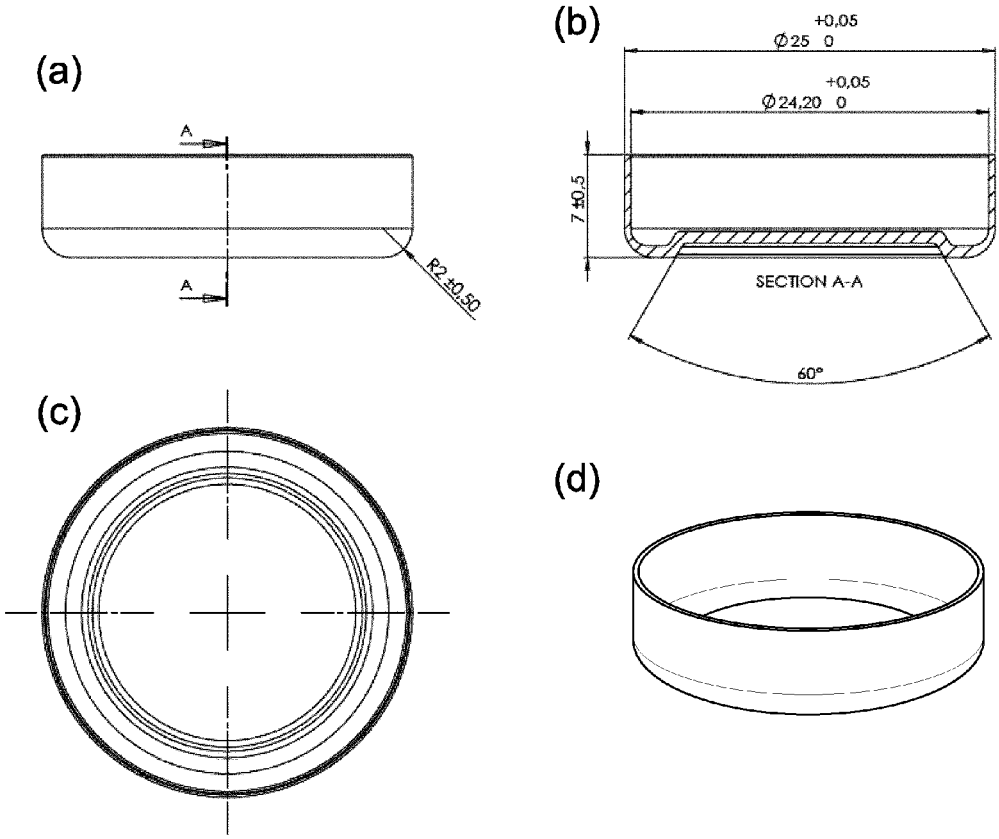

FIG. 4 shows the container according to the invention in cross-section from the side FIG. 5 shows the top casing of a container according to the invention FIG. 6 shows the bottom casing of a container according to the invention FIG. 1 shows a preferred embodiment of a primary vessel in cross-section. A lower wall (2) and side walls (3) enclose a cavity (4). The cavity can be filled with liquid through an opening (5). The primary vessel has the shape of a hollow cylinder in the lower region and in the belly region. The hollow cylinder tapers upwards; a shoulder (6) and a neck (7) are formed. Around the opening (5) is a flange (8) to which a closure can be attached.

Figure 2:
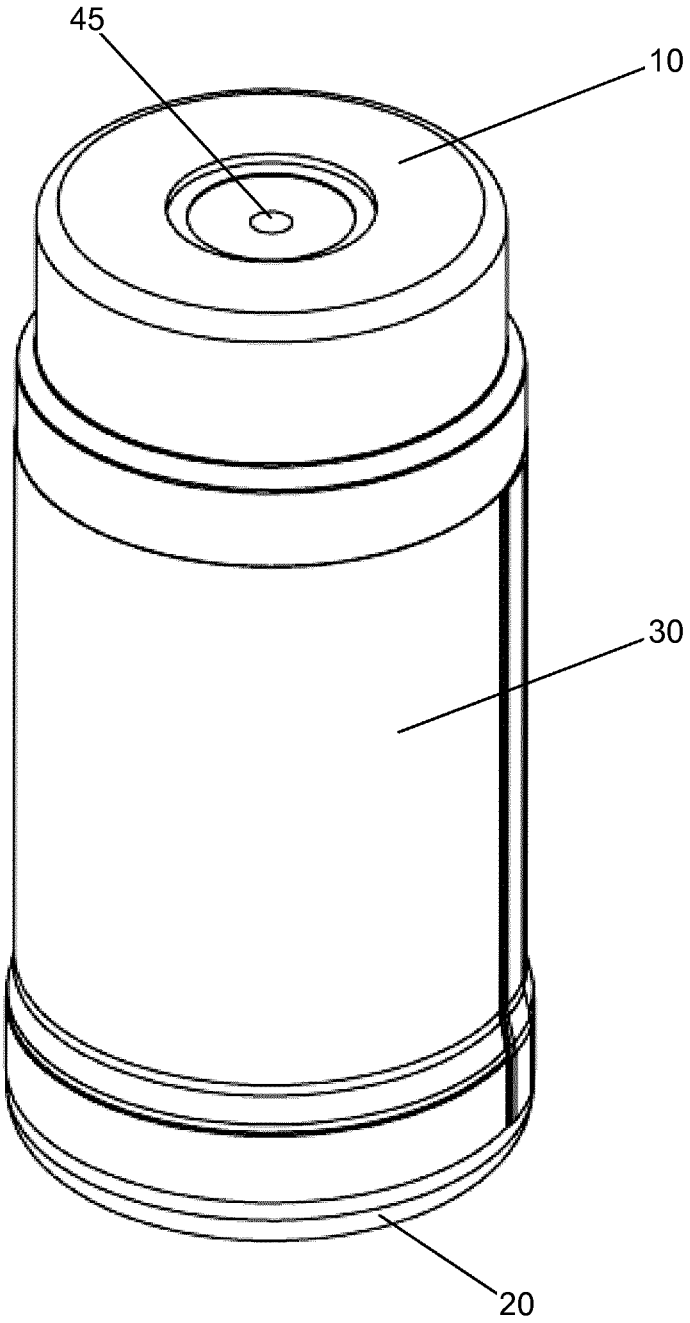
FIG. 2 is a perspective view of the container according to the invention

FIG. 2 shows a container according to the invention in perspective view. The drawing shows the top casing (10) which has an opening. Underneath the opening can be seen the piercing region (45) of the closure. Also shown are the bottom casing (20) and the film (30) that extends between the top casing and bottom casing.

Figure 3:
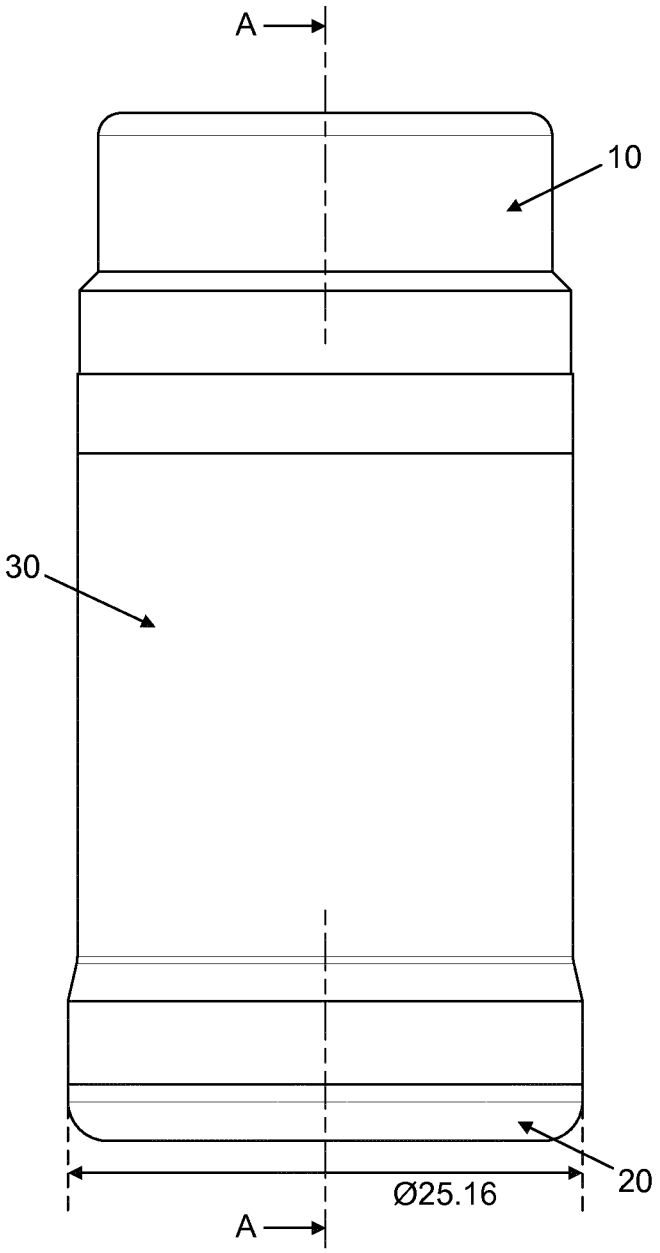
FIG. 3 shows the container according to the invention from the side

FIG. 3 shows a container according to the invention from the side. The drawing shows the top casing (10), the bottom casing (20) and the film (30) that adhesively connects the top and bottom casings to one another.

FIG. 4 shows a container according to the invention in cross-section from the side. A primary vessel (1) is closed off by a septum (43) and a flanged aluminium cap (40). Over the closure is placed a top casing (10) that is frictionally connected to the flanged aluminium cap. The top casing widens out downwardly. It lies flush against the outer primary vessel wall. The bottom casing (20) is frictionally connected to the primary vessel (1) at its base. Around the primary vessel is wrapped a film (30) that extends between the top and bottom casings.

FIG. 5 shows the top casing of the novel container shown in FIGS. 2-4 (*a*) from the side, (b) in cross-section from the side, (c) viewed from above and (d) in perspective view. The top casing has a widened region (12) and a tapering region (14); a shoulder (13) joins the regions together.

FIG. 6 shows the bottom casing of the novel container shown in FIGS. 2-4 (*a*) from the side, (b) in cross-section from the side, (c) viewed from above and (d) in perspective view.

The invention claimed is:

1. A container for a liquid, comprising a cavity for holding the liquid, the cavity being bounded by walls at the sides and at the bottom, an opening for filling the cavity with the liquid, a closure for closing off the cavity, the closure having a piercing region for inserting a cannula into the cavity, a bottom casing which surrounds the walls of the cavity at its base, a top casing which surrounds the pierceable closure with the exception of the piercing region, and a film which extends from the top casing to the bottom casing, joining the bottom casing and top casing together, and surrounds those areas of the walls of the cavity which are not already surrounded by the top casing or bottom casing; wherein the film is adhesively bonded to the top casing, the bottom casing, and the walls;

wherein the walls of the cavity and the closure form an inner shell constituting a primary vessel, and wherein the bottom casing, top casing, and film together enclose any surface contamination on the primary vessel.

2. The container according to claim 1, characterised in that the walls that bound the cavity are made of glass.

3. The container according to claim 1, characterised in that the top casing is frictionally connected to the closure.

4. The container according to claim 1, characterised in that the bottom casing is frictionally connected to the walls at the base.

5. The container according to claim 1, characterised in that the top and/or bottom casing consist(s) of an elastic polymer.

6. The container according to claim 1, characterised in that the film is partially adhesively bonded to itself.

7. The container according to claim 1, characterised in that said primary vessel is in the shape of a hollow cylinder in its base and belly region, that tapers upwardly towards the opening so as to form a shoulder and a neck, and in that a flange is provided around the opening.

8. The container according to claim 7, characterised in that the closure has an apron that is secured to the flange of the primary vessel.

9. The container according to claim 1, characterised in that the top casing has an upper region that is of tapered cross-section and a lower region of widened cross-section in the manner of a telescopic cylinder, the upper region being provided for connection to the closure and the lower region fitting flush with the walls that enclose the cavity.

10. The container according to claim 1 containing at least one radionuclide.

11. A use of a container according to claim 1, for holding and storing radioactive substances, particularly radioactive substances that are used for therapeutic and/or diagnostic purposes.

12. The use according to claim 11 wherein said radioactive substance comprises at least one alpha-emitting radionuclide.

13. The use according to claim 11, characterised in that the container contains a single dose of the medicament.

* * * * *